US006894666B2

(12) United States Patent
Otawara et al.

(10) Patent No.: US 6,894,666 B2
(45) Date of Patent: May 17, 2005

(54) CONTRAST CORRECTING CIRCUIT

(75) Inventors: Masayuki Otawara, Yokohama (JP); Hidehito Ogawa, Yokohama (JP); Ryutaro Okamoto, Yokohama (JP)

(73) Assignee: Samsung SDI Co., Ltd., Suwon-si (KR)

( * ) Notice: Subject to any disclaimer, the term of this patent is extended or adjusted under 35 U.S.C. 154(b) by 294 days.

(21) Appl. No.: 10/305,013

(22) Filed: Nov. 27, 2002

(65) Prior Publication Data

US 2003/0107681 A1 Jun. 12, 2003

(30) Foreign Application Priority Data

Dec. 12, 2001 (JP) ..... 2001-378797
Dec. 12, 2001 (JP) ..... 2001-378798
Feb. 27, 2002 (JP) ..... 2002-050911

(51) Int. Cl.[7] ..... G09G 3/36

(52) U.S. Cl. ..... 345/77; 345/63; 345/84; 345/87; 345/89; 345/90; 345/98; 345/102; 345/204; 345/214

(58) Field of Search ..... 345/63, 77, 84, 345/87, 89, 90, 98, 102, 204, 214

(56) References Cited

U.S. PATENT DOCUMENTS 5,369,510 A * 11/1994 Taguchi ..... 358/529
5,793,501 A * 8/1998 Murakami ..... 358/520
6,151,410 A * 11/2000 Kuwata et al. ..... 382/167
2001/0033260 A1 10/2001 Nishitani et al.

FOREIGN PATENT DOCUMENTS

| | | |
|---|---|---|
| EP | 0 467 602 A2 | 12/1991 |
| EP | 0 516 083 A2 | 5/1992 |
| JP | 11-327496 | 3/1999 |
| JP | 2001-136411 | 5/2001 |
| WO | WO 99/26224 A1 | 11/1999 |

OTHER PUBLICATIONS

*"Communication" and "Search Report"* issued by European Patent Office dated on Feb. 24, 2003.

* cited by examiner

*Primary Examiner*—Bipin Shalwala
*Assistant Examiner*—Vincent E. Kovalick
(74) *Attorney, Agent, or Firm*—Robert E. Bushnell, Esq.

(57) ABSTRACT

A contrast correcting circuit for preventing white distortion in a dark screen comprises: an integrator for integrating brightness levels of video signals, and for calculating a sum of the brightness levels; a ROM for storing different types of table data exhibiting contrast conversion characteristics according to the brightness; a selection signal generator for setting as a reference value the sum of the brightness levels of all of the pixels when the brightness levels are at a maximum, for comparing the reference value with an integration output of the integrator, and for instructing the ROM to selectively output table data suitable for the brightness of a screen selected from the different types of table data; and a RAM for storing a conversion table for correcting the contrasts of the video signals by means of the table data.

21 Claims, 7 Drawing Sheets

CONTRAST CORRECTING CIRCUIT

CLAIM OF PRIORITY

This application makes reference to, incorporates the same herein, and claims all benefits accruing under 35 U.S.C. §119 from our two applications, CONTRAST CORRECTING CIRCUIT, filed with the Japan Patent Office on Dec. 12, 2001 and there duly assigned Serial Nos. 2001-378797 and 2001-378798, and an application, CONTRAST CORRECTING CIRCUIT, filed with the Japan Patent Office on Feb. 27, 2002 and there duly assigned Serial No. 2002-050911.

BACKGROUND OF THE INVENTION

1. Technical Field

The present invention relates to a contrast correcting circuit. More specifically, the present invention relates to a contrast correcting circuit suitable for use in a display device having a small dynamic range, such as a plasma display panel (PDP).

2. Related Art

A contrast correcting circuit for emphasizing the contrast of areas in a picture having a large amount of information is commonly used in a display device having a small dynamic range, such as a plasma display panel (PDP). Such a contrast correcting circuit ensures a higher quality picture.

In a conventional contrast correcting circuit, a plurality of different types of look-up tables containing varying contrast conversion characteristics are used for converting a contrast in order to emphasize the contrast of a picture. The tables are stored in a memory such as a read only memory (ROM). The result of integrating picture data for a screen, or the result of obtaining a histogram, is used for selecting such look-up tables.

Excellent images are obtained on most screens when a conventional contrast correcting circuit that converts the contrast of picture data using a plurality of look-up tables is used.

However, there are instances when it is better not to correct the contrast. In particular, picture data of a dark screen in a movie should not undergo contrast conversion. When there exists a small area having a relatively bright image in a picture having a large number of pixels of a black level, because much of the picture is formed of images that are realized using pixels of the black level with respect to an area ratio (that corresponds to the amount of data), a look-up table having a contrast conversion characteristic that is effective in a dark screen is easily selected in the conventional contrast correcting circuit.

However, when there exists a small area of a relatively bright image in a picture having a large number of pixels of a black level, important information is included in the small area of the picture. When the contrast is corrected in such a screen by selecting the look-up table for a dark screen, deterioration such as white distortion easily occurs.

SUMMARY OF THE INVENTION

It is an object of the present invention to provide a contrast correcting circuit which is capable of preventing white distortion in a dark screen.

When there exists an area or areas of a dark image in a screen that is mostly white, such as a snowy scene, a situation opposite to the above results. That is, black distortion occurs and important information may not be clearly displayed.

It is another object of the present invention to provide a contrast correcting circuit, which is capable of appropriately correcting the contrast of an image in a picture when the majority of the screen is of a uniform gray scale and the image occupies a small part of the screen.

In one aspect of the present invention, there is provided a contrast correcting circuit, comprising: an integrator for integrating brightness levels of received video signals and calculating a sum of the brightness levels of the video signals of an entire screen; a first memory for storing a plurality of different types of table data exhibiting contrast conversion characteristics according to the brightness of a screen; a selector for setting as a reference value the sum of the brightness levels of all of the pixels when the brightness levels of all of the pixels of the screen are at a maximum, for comparing the reference value with an integration output of the integrator, and for instructing the first memory to selectively output table data suitable for the brightness of a screen, selected from the plurality of different types of table data on the basis of the comparison result; a second memory for storing a conversion table for correcting the contrasts of the received video signals by the table data output from the first memory; and a black level detector for detecting the brightness levels of the received video signals for each pixel, for determining the brightness levels of the video signals to be the black level when the brightness levels of the video signals have values less than or equal to a predetermined value, and for outputting data indicating the number of pixels of the black level. In the case where the number of pixels of the black level detected by the black level detector is greater than or equal to a predetermined value, the selector sets the reference value compared with the output of the integrator as a value obtained by subtracting the number of pixels of the detected black level from the sum of the brightness levels of all of the pixels when the brightness levels of all of the pixels of the screen are detected to be at a maximum.

The predetermined value is set as the number of pixels corresponding to an area of a black screen when the ratio of the area of a display region receiving particular viewing attention to the ratio of an entire display screen is previously defined, and the background is a black screen.

Preferably, the brightness levels of the video signals are determined to be the black level when the gray scales of the video signals are in the range of 0–5.

Table data showing a conversion characteristic are obtained by uniformly dividing a space between a characteristic selected with respect to an entirely dark picture, where the mean value of the brightness levels of the video signals is small, and a characteristic selected with respect to an entirely bright picture, where the mean value of the brightness levels of the video signals is large, and such table data are stored in the first memory.

Preferably, table data exhibiting 16 conversion characteristics are stored in the first memory.

In another aspect of the present invention, there is provided a contrast correcting circuit, comprising: an integrator for integrating brightness levels of received video signals and calculating a sum of the brightness levels of the video signals of an entire screen; a first memory for storing a plurality of different types of table data exhibiting contrast conversion characteristics according to the brightness of a screen; a selector for setting as a reference value the sum of the brightness levels of all of the pixels when the brightness levels of all of the pixels of the screen are maximum, for comparing the reference value with an integration output of the integrator, and for instructing the first memory to selectively output table data suitable for the brightness of a screen among the plurality of different types of table data on the basis of the comparison result; a second memory for storing a conversion table for correcting the contrasts of the received video signals by the table data output from the first memory; and a corrector for correcting the reference value when the black levels of the received video signals continuously exist for each pixel and the number of continuous pixels is greater than or equal to a predetermined value. When a correction input from the corrector exists, the selector sets the value corrected according to the correction input as a reference value and specifies table data to be selected from the plurality of different types of table data.

The corrector comprises: a black level detector for detecting the brightness levels of the received video signals for each pixel, and for determining the brightness levels of the video signals to be the black level when the brightness levels of the video signals have values less than or equal to a predetermined value; a first counter for counting the number of pixels of the black level detected by the black level detector in a horizontal scan period, defined by a certain number of pixels which is established externally, by the set number of pixels only when the pixels are continuous, and for outputting the count value of the number of pixels of the black level with respect to the respective lines of a row direction of the screen; and a second counter for receiving the count output of the first counter when the count values of the number of pixels of the black level are continuously input from the first counter with respect to the number of lines of a row direction of the screen set from the outside, and for outputting the sum of the count values to the selector as a count value. The selector sets the reference value in comparison with the output of the integrator as a value obtained by replacing a value indicating the number of all pixels of the screen in a calculation formula that indicates the sum of the brightness levels of all pixels when the brightness levels of all of the pixels of the screen are at a maximum by a value obtained by subtracting the count value of the number of pixels of the black level output from the second counter from the value indicating all of the number of pixels of the screen.

The number of pixels set by the first counter and the number of lines set by the second counter are determined by considering a noise component with respect to the video signals.

Preferably, the number of pixels set by the first counter is four, and the number of lines set by the second counter is four.

In another aspect of the present invention, there is provided a contrast correcting circuit, comprising: an integrator for integrating brightness levels of received video signals, and for calculating a sum of the brightness levels of the video signals for an entire screen; a first memory for storing a plurality of different types of table data exhibiting contrast conversion characteristics according to the brightness the screen; a selector for setting as a reference value the sum of the brightness levels of all of the pixels when the brightness levels of all of the pixels of the screen are at a maximum, for comparing the reference value with an integration output of the integrator, and for instructing the first memory to selectively output table data suitable for the brightness of the screen, selected from a plurality of different types of table data on the basis of the comparison result, or in consideration of the gray scales of the received video signals together with the comparison result; a second memory for storing a conversion table for correcting the contrasts of the received video signals by means of the table data output from the first memory; a histogram detector for dividing gray scales of received video signals into a plurality of regions, and for detecting frequencies of scales belonging to the divided regions in unit of pixels; and a controller for receiving a detection output of the histogram detector, for determining the gray scale to be uniform when a gray scale whose frequency is greater than or equal to a previously set threshold value exists, and for outputting data on the gray scale determined to be uniform and the frequency of the gray scale. When data on the gray scale determined to be uniform gray scale by the controller and the frequency of the gray scale are received, the selector sets a reference value, which is compared with the output of the integrator, as a value obtained by subtracting the product of the gray scale determined to be the uniform gray scale and the frequency of the gray scale from the sum of the brightness levels of all of the pixels when the brightness levels of all of the pixels of the screen are at a maximum. Then, the selector instructs the first memory to selectively output the table data suitable for the brightness of the screen selected from the plurality of table data on the basis of a value obtained by dividing the reference value by the sum of the brightness levels when the brightness levels of all of the pixels of the picture region (except for the picture region occupied by the gray scale determined to be the uniform gray scale) are at a maximum with respect to one screen.

In a screen where the ratio of the area of a display region to receive particular viewing attention to the area of an entire display screen is previously defined, and the background has uniform gray scales, the threshold value is set as the number of pixels corresponding to the area of the screen of the uniform gray scales.

When a frequency is set with respect to a gray scale that is not supposed to be determined in determining whether or not a gray scale is uniform, the controller does not output data on the frequency of the gray scale.

Preferably, the brightness levels of the video signals are determined to be the black level when the gray scales of the video signals are in a range of 0–5, the brightness levels of the video signals are determined to be a gray level when the gray scales of the video signals are in a range of 125–130, and the brightness levels of the video signals are determined to be a white level when the gray scales of the video signals are in a range of 250–255.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference numerals indicate the same or similar components, and wherein.

DETAILED DESCRIPTION OF THE PREFERRED EMBODIMENTS

In the following detailed description, only the preferred embodiments of the invention have been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

Figure 1:
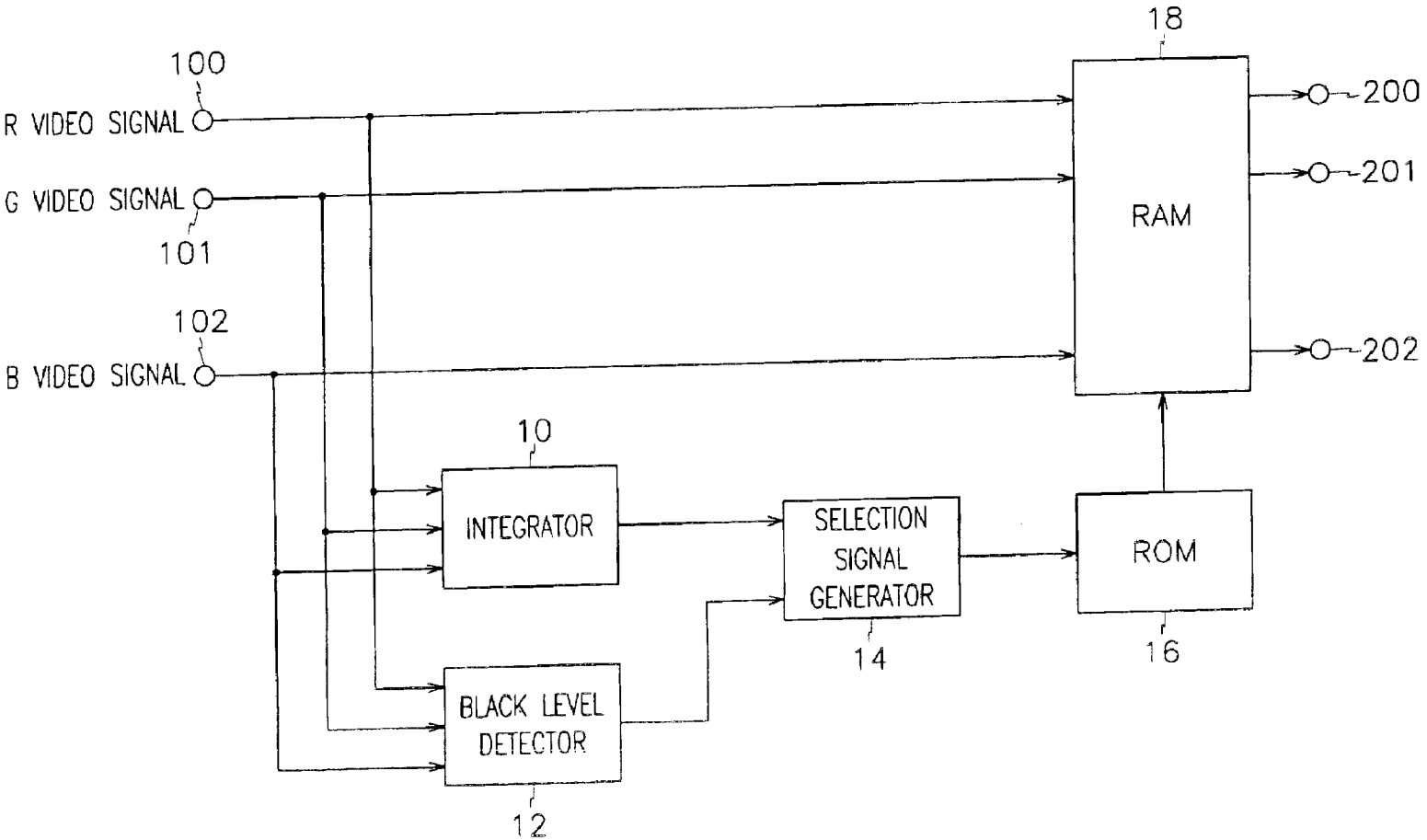
FIG. 1 is a block diagram showing the structure of a contrast correcting circuit according to a first embodiment of the present invention.

FIG. 1 shows the structure of a contrast correcting circuit according to a first embodiment of the present invention. Referring to FIG. 1, the contrast correcting circuit includes an integrator 10, a black level detector 12, a selection signal generator 14, a read only memory (ROM) 16, and a random access memory (RAM) 18.

The integrator 10 integrates the brightness levels of input video signals, and calculates the sum of the brightness levels of the video signals for an entire screen.

The black level detector 12 detects the brightness level of the input video signals for each pixel, determines that the brightness level is a black level when the brightness level of the video signals is less than or equal to a predetermined value, and outputs data that indicate the number of pixels of the black level. That is, the black level detector 12 determines that the brightness level is the black level when all of the R, G, and B video signals, input from input terminals 100, 101, and 102 are less than or equal to a predetermined value. Then, the black level detector 12 calculates and outputs the corresponding number of pixels.

Using as a reference value the sum of the brightness levels of all of the pixels when the brightness levels of all of the pixels of a screen are at a maximum, the selection signal generator 14 compares the reference value with the integration output of the integrator 10. Based on the result of this comparison, the selection signal generator 14 instructs the ROM 16 to selectively output table data, selected from a plurality of different types of table data stored in the ROM 16 as suitable for the brightness of the screen.

In the case where the number of pixels of the black level detected by the black level detecting unit 12 is greater than or equal to a predetermined value, the selection signal generator 14 sets the reference value compared with the output of the integrator 10 to a value obtained by subtracting the number of pixels of the detected black level from the sum of the brightness levels of all of the pixels when the brightness levels of all of the pixels of the screen are at a maximum.

A plurality of different types of table data exhibiting varying conversion characteristics, which are selected according to the brightness of a screen, are stored in the ROM 16. The ROM 16 outputs the table data having the contrast conversion characteristic selected by the selection signal output from the selection signal generator 14. A conversion table for correcting the contrasts of the video signals, which are input from the input terminals 100 thru 102, by means of the table data output from the ROM 16 is stored in the RAM 18. The video signals having contrasts which are corrected by the conversion table stored in the RAM 18 are output to output terminals 200 thru 202.

Figure 2:
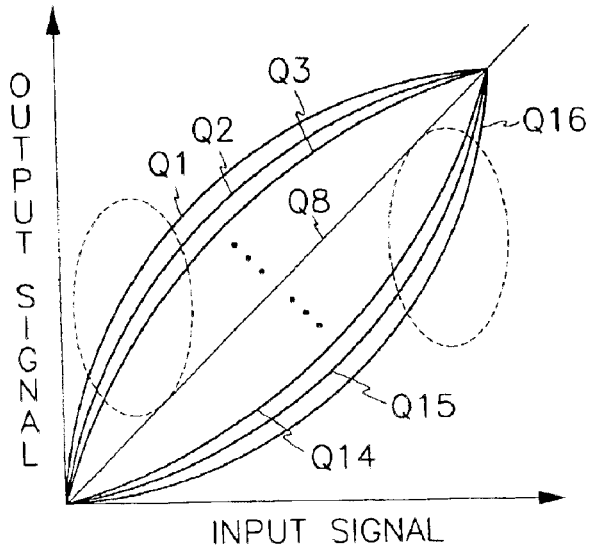
FIG. 2 is a view showing contrast conversion characteristics exhibited by table data stored in a read only memory (ROM) of the contrast correcting circuit of FIG. 1.

The selection signal generator 14 corresponds to a selector of the present invention, the ROM 16 corresponds to a first memory of the present invention, and the RAM 18 corresponds to a second memory of the present invention. The plurality of different types of table data exhibiting various contrast conversion characteristics, which are stored in the ROM 16, will now be described with reference to FIG. 2. FIG. 2 shows the contrast conversion characteristics of a picture. Referring to FIG. 2, the contrast conversion characteristic shown by the curve Q1 is selected with respect to a picture wherein the mean value of the brightness levels of input video signals is small, and which is entirely dark. The contrast conversion characteristic shown by the curve Q16 is selected with respect to a picture wherein the mean value of the brightness levels of input video signals is large, and which is entirely bright. The contrast of the picture data in a region marked with a dotted line is emphasized.

According to the present embodiment, table data (value data) exhibiting 16 contrast conversion characteristics of the curves Q1 thru Q16, obtained by uniformly dividing a space between the curve Q1 and the curve Q16, are stored in the ROM 16. Predetermined table data are selected according to the mean value of the brightness levels of the input video signals.

The operation of the contrast correcting circuit according to the first embodiment of the invention will now be described.

Referring to FIG. 1, when the R, G, and B video signals (digital signals) are received from the input terminals 100 thru 102, the integrator 10 integrates the brightness levels of the input video signals and calculates the sum (the mean value) S0 of the brightness levels of the video signals for the entire screen. When the size of a screen is 852 (dots)×480 (lines), and a pixel is displayed with 8 bits with respect to R, G, and B, the sum Sm of the brightness levels of all of the pixels, when the brightness levels of all of the pixels of a screen are at a maximum, is Sm=852 (dots)×480 (lines)×255 (8 bit-maximum value)×3 (RGB)=312854400.

The sum (the mean value) S0 of the brightness levels of the video signals for the entire screen, which is calculated by the integrator 10, is replaced by a selection signal for selecting the table data by the selection signal generator 14. That is, the selection signal has a value obtained by dividing the output S0 of the integrator 10 by the sum Sm (the output of an integrator (the sum)÷312854400), that is, either 0 or 1. The values are uniformly assigned to be suitable for the number of contrast conversion tables formed from the table data exhibiting each of the contrast conversion characteristics Q1 thru Q16. Each grouping of the table data exhibiting each of the contrast conversion characteristics is referred to as a contrast conversion table.

When there are 16 kinds of contrast conversion table, the selection signal for selecting the contrast conversion table according to the calculation result of the selection signal generator 14 is output to the ROM 16 as follows.

The selection signal for selecting the contrast conversion table Q1 when S0/Sm=0 thru 0.0625, for selecting the contrast conversion table Q2 when S0/Sm=0.0625 thru 0.125, selecting the contrast conversion table Q15 when S0/Sm=0.875 thru 0.9375, and for selecting the contrast conversion table Q16 when S0/Sm=0.9375 thru 1, is output to the ROM 16.

As a result, the ROM 16 outputs to RAM 18 the table data having the contrast conversion characteristic which is selected by the selection signal output from the selection signal generator 14. Using the conversion table, the RAM 18 corrects the contrasts of the R,G, and B video signals received from the input terminals 100 thru 102 on the basis of the table data received from the ROM 16, and outputs the R,G, and B video signals having contrasts which are corrected through the output terminals 200 thru 202.

Accordingly, an image having a contrast of a dark part which is emphasized is obtained when the entire screen is dark, and an image having a contrast of a bright part which is emphasized is obtained when the entire screen is bright.

In most cases, it is possible to realize the desired contrast correction by this method. However, as mentioned above, there may be negative consequences to performing contrast correction in this manner. A detailed example will now be described with reference to FIG. 3.

Figure 3:
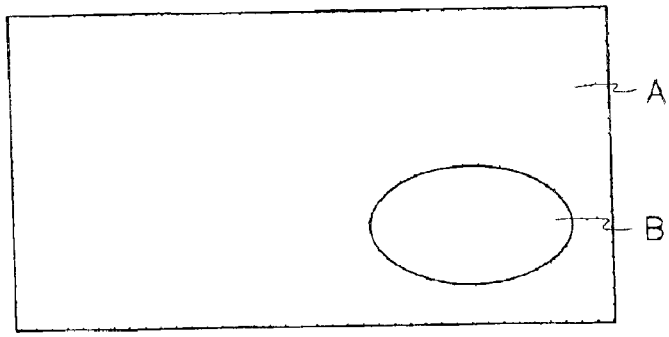
FIG. 3 is a view showing a screen where a relatively small image of a bright gray scale, which is close to white in color, exists in a background of a gray scale that is mostly a black level.

FIG. 3 shows a screen wherein most of a background A is the gray scale of the black level, and wherein a relatively small image B of a bright gray scale, which is close to white in color, exists in the background A. In the case of the screen shown in FIG. 3, because the output of the integrator 10 (that is, the sum or mean value of the brightness levels of the video signals of the entire screen) has a low value, when a black level detector is not included in the structure of FIG. 1, the contrast conversion table corresponding to the dark screen is selected. As a result, the contrast of the bright area is somewhat retarded, while the contrast of the dark area is emphasized.

Despite the fact that an important video signal exists in the bright area, the contrast of that portion is reduced, and a phenomenon such as white distortion occurs as a result.

In order to avoid such a phenomenon, in the first embodiment of the present invention, the sum of the video signals is integrated by the integrator 10. When the brightness levels of the R, G, and B video signals, received from the input terminals 100, 101, and 102 by the black level detector 12, have values less than or equal to a predetermined value, the brightness levels are determined to be the black levels, and the number of pixels is calculated and output.

The brightness levels are determined to be the black levels by the black level detector 12 when the brightness levels have values that are less than or equal to a predetermined value because, when a noise component is included in the video signals, all of the brightness levels of the video signals detected by the black level detector 12 are not zero, even when the brightness levels are the black levels. In the present embodiment, the brightness levels are determined to be the black levels when the gray levels of the video signals are in the range of 0–5, and are determined to be levels other than the black levels when the gray levels of the video signals are in the range of 6–255.

When the number of pixels calculated to be the black level by the black level detector 12 is greater than or equal to a predetermined value, the number of pixels calculated to be the black level by the black level detector 12 is subtracted when the sum Sm of the brightness levels of all of the pixels, when the brightness levels of all of the pixels of the screen are at a maximum, is calculated using the calculation formula of the selection signal generated by the selection signal generator 14. That is, the selection signal S0/Sm' is calculated using Sm', which is obtained by the following formula (instead of Sm):

$$Sm'=\{852(\text{dots})\times 480(\text{lines})-(\text{value calculated to be the black level})\times 3\}\times 255(\text{8 bit maximum value})\times 3(RGB)\}$$

Also, the area ratio of a display region in the entire screen that receives particular viewing attention is pre-defined in the predetermined value. When the background is black, the predetermined value may be set to the number of pixels corresponding to the area of the black screen. For example, when a relatively small image (e.g., a display region ¼ of the entire screen) of a bright gray scale that is close to white in color is displayed on a black background, the value set as a predetermined value by the selection signal generator 14 is 852×480×¾=306720 when ¾ of a 852×480 display screen is black.

The contrast correcting circuit according to the second embodiment of the present prevents the white distortion phenomenon from occurring due to the correction of the contrast when, as shown in FIG. 3, most of the background A is the gray scale of the black level, and an image B of a bright gray scale, close to white in color, exists in the background A (as in the first embodiment).

Figure 4:
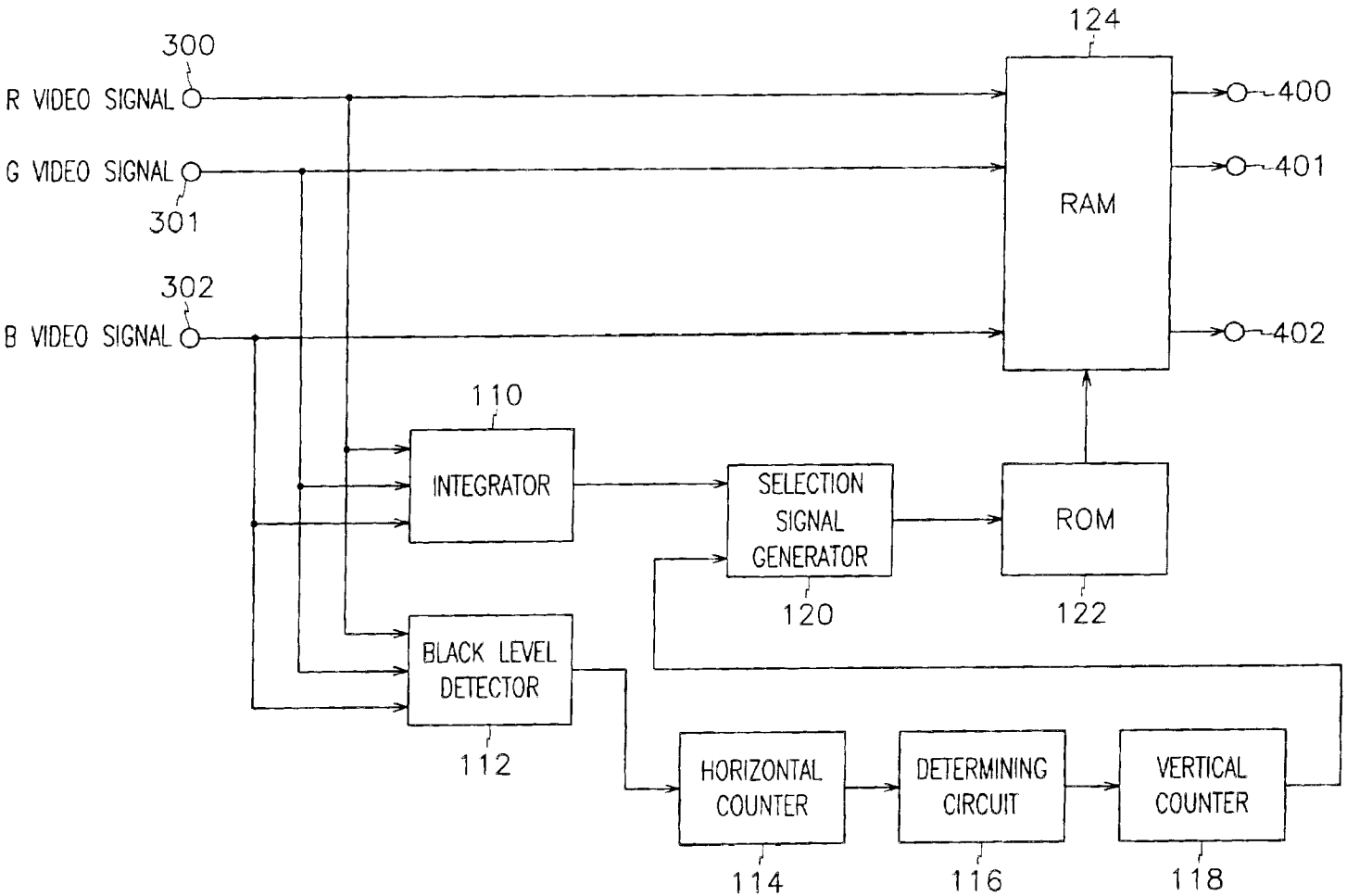
FIG. 4 is a block diagram showing the structure of a contrast correcting circuit according to a second embodiment of the present invention.

The structure of the contrast correcting circuit according to the second embodiment of the present invention is shown in FIG. 4. Referring to FIG. 4, the contrast correcting circuit includes an integrator 110, a black level detector 112, a horizontal counter 114, a determining circuit 116, a vertical counter 118, a selection signal generator 120, ROM 122, and RAM 124.

The integrator 110 integrates the brightness levels of received video signals, and calculates the sum of the brightness levels of the video signals for the entire screen.

The black level detector 112 detects the brightness levels of the received video signals for each pixel, and determines that the brightness levels of the video signals are the black levels when the brightness levels of the video signals have values that are less than or equal to a predetermined value. That is, the black level detector 112 determines that the brightness levels of the video signals are the black levels when all of the R, G, and B video signals, received from input terminals 300, 301, and 302, have values that are less than or equal to a predetermined value, after which the black level detector 112 outputs a corresponding determination signal.

The horizontal counter 114 calculates the number of pixels of the black level detected by the black level detector 112 in one horizontal scanning period, defined by a certain number of pixels which is externally established, by the established number of pixels only when the pixels of the black level are continuous. The calculation value of the number of pixels of the black level is output with respect to each line of a row direction of a screen. The number of pixels established externally is, for example, 4 when the screen is 852 (dots)×480 (lines) in size.

The determining circuit 116 outputs the count output of the horizontal counter 114 to the vertical counter 118 only when the number of pixels of the black level of every line output from the horizontal counter 114 is greater than or equal to a predetermined level. The predetermined value is set to be 800, for example. The determining circuit 116 may be omitted by including the function of the determining circuit 116 in the horizontal counter 114. The vertical counter 118 receives the count output of the horizontal counter 114 and, when the count values (not zero) of the number of pixels of the black level are continuously input from the horizontal counter 114 via the determining circuit 116 (the count value corresponding to the number of lines of a row direction of a screen established externally), the vertical counter 118 outputs the sum of the count values to the selection signal generator 120. The number of lines established externally is, for example, 4. Also, the respective values set in the horizontal counter 114, the determining circuit 116, and the vertical counter 118 are determined by considering a noise component for a non-video signal.

The horizontal counter 114 and the determining circuit 116 correspond to a first counter and a second counter, respectively, of the present invention.

Setting the sum of the brightness levels of all of the pixels, when the brightness levels of all of the pixels of a screen are at a maximum, as a reference value, the selection signal generator 120 compares the reference value with the integration output of the integrator 110. On the basis of the comparison result, the selection signal generator 120 then instructs the ROM 116 to selectively output the table data, selected from the plurality of different types of table data stored in the ROM 116, as suitable for the brightness of the screen.

The selection signal generator 120 sets the reference value compared with the output of the integrator 110 to a value obtained by replacing a value, indicating the number of all of the pixels of the screen in a calculation formula that indicates the sum of the brightness levels of all the pixels when the brightness levels of all of the pixels of the screen are at a maximum, by a value obtained by subtracting the count value of the number of pixels of the black level output of the vertical counter 118 from the value indicating the number of all of the pixels of the screen.

The plurality of different types of table data showing the contrast conversion characteristics, which are selected according to the brightness of the screen, are stored in the ROM 122. The ROM 122 outputs the table data of the contrast conversion characteristic selected according to the selection signal output from the selection signal generator 120.

A conversion table for correcting the contrasts of the video signals, received from the input terminals 300 thru 302, according to the table data output from the ROM 122 is stored in the RAM 124. The video signals having contrasts which are corrected according to the conversion table stored in the RAM 124 are output through output terminals 400 thru 402.

The selection signal generator 120 corresponds to a selector of the present invention, the ROM 122 corresponds to a first memory of the present invention, and the RAM 124 corresponds to a second memory of the present invention.

The plurality of different types of table data exhibiting the contrast conversion characteristics, which are stored in the ROM 122, were described with reference to FIG. 2 in the above explanation of the first embodiment of the present invention.

The operation of the contrast correcting circuit according to the second embodiment of the present invention will now be described.

In the case of the screen shown in FIG. 3, because the output of the integrator 110 (that is, the sum (the mean value) of the brightness levels of the video signals of the entire screen) has a low value, when the black level detector 112, the horizontal counter 114, the determining circuit 116 and the vertical counter 118 are not included in the structure shown in FIG. 4, a contrast conversion table corresponding to the dark screen is selected. The contrast of the bright area is sacrificed in the screen, and the contrast of the dark area is emphasized.

Despite the fact that important video signals are in the bright area, the contrasts of this area are reduced, resulting in a phenomenon such as white distortion.

In order to avoid such a phenomenon, in the present embodiment, as in the first embodiment, the sum of the video signals is integrated by the integrator 110 and, when the brightness levels of the R, G, and B video signals, received from the input terminals 300, 301, and 302 by the black level detector 112, have values less than or equal to a predetermined value, the brightness levels are determined to be the black levels.

Figure 5:
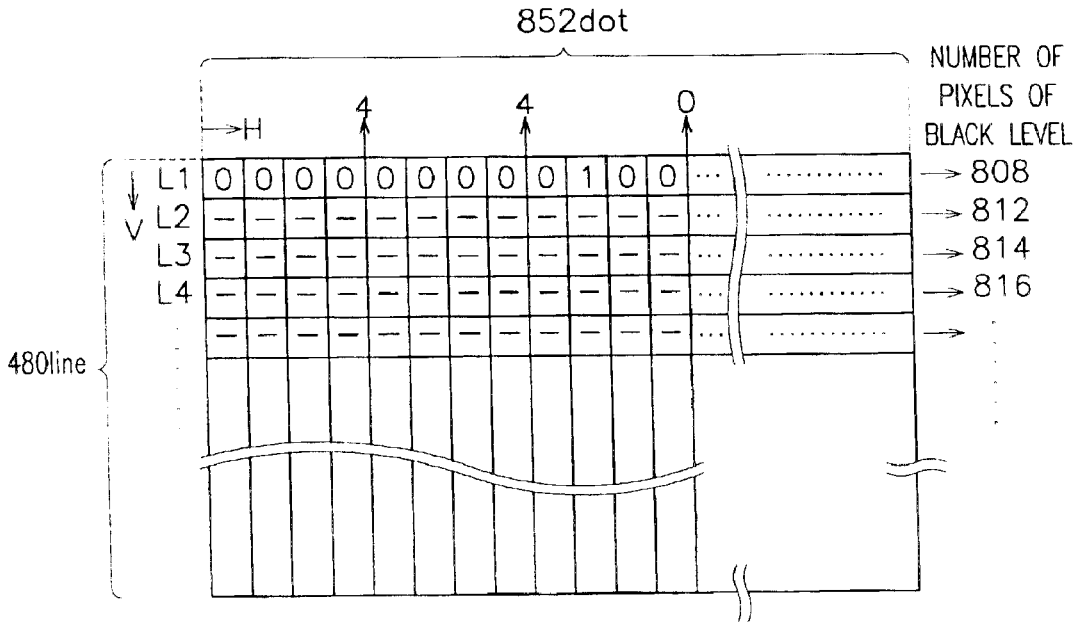
FIG. 5 is a view showing a detection result of respective pixels in a screen by a black level detector.

Referring to FIG. 5, in a screen (852 dots×480 lines), a recorded detection result is shown, in which result pixels determined by the black level detector 112 to be the black level are set to 0, while pixels determined to be all other levels (that is, determined as 'signals exist') are set to 1. In this embodiment, the operations of the horizontal counter 114, the determining circuit 116, and the vertical counter 118 will be described.

The horizontal counter 114 counts the number of pixels of the black level, which are detected by the black level detector 112, in a horizontal scan period 1H defined by a certain number of pixels established externally, only when the pixels are continuous according to the set number of pixels, and horizontal counter 114 outputs the count value of the number of pixels of the black level with respect to each line of a row direction of a screen.

For example, as shown in FIG. 5, when black level detector 112 detects 0000, 0000 and 0100 with respect to the first four pixels, the next four pixels and the next four pixels after that in a line L1 of a first row and in a row H direction, the horizontal counter 114 counts 4, 4, and 0 every four pixels, and the sum of the count value for every four pixels (808) is output as the count value of the line L1.

The count outputs of the horizontal counter 114 are 812, 814, and 816 for lines L2, L3, and L4, respectively.

The determining circuit 116 outputs the count output of the horizontal counter 114 to the vertical counter 118 only when the number of pixels of the black level for every line, as output from the horizontal counter 114, is greater than or equal to a predetermined value. The predetermined value forming the basis of the latter determination is set to 800, as described above. Therefore, in this example, 808, 812, 814, and 816 are output from the determining circuit 116 to the vertical counter 118 for lines L1 thru L4, respectively. When the number of pixels of the black level of each line is less than 800, the determining circuit 116 outputs 0 with respect to each such line.

The vertical counter 118 receives the count output of the horizontal counter 114 and, when the count values (not zero) of the number of pixels of the black level are continuously input from the horizontal counter 114 via the determining circuit 116 (the count values corresponding to the number of lines (4 in the present embodiment) of a row direction of a screen established externally), the vertical counter 118 outputs the sum of the count values to the selection signal generator 120.

In this example, because 808, 812, 814, and 816 are input from the determining circuit 116 for lines L1 through L4, respectively, the vertical counter 118 outputs 3250, which is the sum of these inputs, with respect to the first four lines.

When 0 is output from the determining circuit 116 with respect to at least one line among four lines, the output of the vertical counter 118 with respect to the four lines becomes 0.

The selection signal generator 120 sets the reference value compared with the output of the integrator 110 to a value obtained by replacing the value indicating the number of all of the pixels of the screen in a calculation formula, indicating the sum of the brightness levels of the number of pixels when the brightness levels of all of the pixels of the screen are at a maximum, by a value obtained by subtracting the count value of the number of pixels of the black level, output from the vertical counter 118, from the value indicating the number of all of the pixels of the screen.

A selection signal (S0/Sm') is calculated using Sm', which is obtained by the following formula (instead of Sm):

$$Sm'=\{852(\text{dots})\times 480(\text{lines})-(\text{the value counted to be the black level (the count output of the vertical counter } \mathbf{118}))\}\times 255(\text{8 bit maximum value})\times 3(RGB)\}$$

With respect to the contrast correcting circuit of the second embodiment of the present invention, because the table data having an appropriate contrast conversion characteristic are selected for a screen with a large amount of pixel data of the black level, it is possible to prevent the generation of white distortion in the screen where most of the background is occupied by pixels of the black level.

Figure 7:
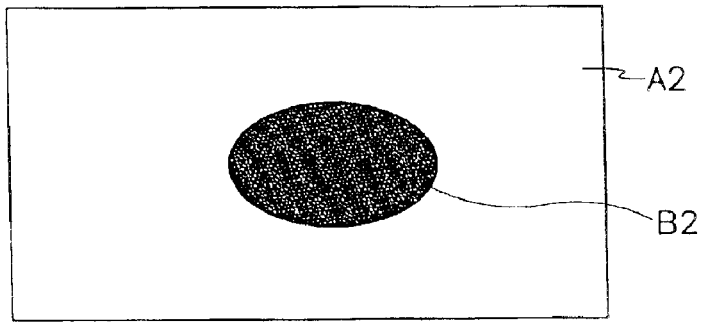
FIG. 7 is a view showing a screen where most of the background is a gray scale of a white level, and a relatively small image of a dark gray scale, that is close to black in color, exists in the background.

The contrast correcting circuit according to a third embodiment not only prevents the occurrence of the negative consequences caused by the correction of the contrast (that is, the white distortion phenomenon) when most of the background A is the gray scale of the black level and the image B of the bright gray scale, close to white in color, exists in the background A, as with the first and second embodiments, as shown in FIG. 3, but the third embodiment also prevents the occurrence of the negative consequences caused by the correction of the contrast. That is, the contrast correcting circuit according to the third embodiment prevents the occurrence of the black distortion phenomenon when most of the background A2 is the gray scale of the white level and the image B2 of the dark gray scale, close to black in color, exists in the background A2, as shown in FIG. 7.

Figure 8:
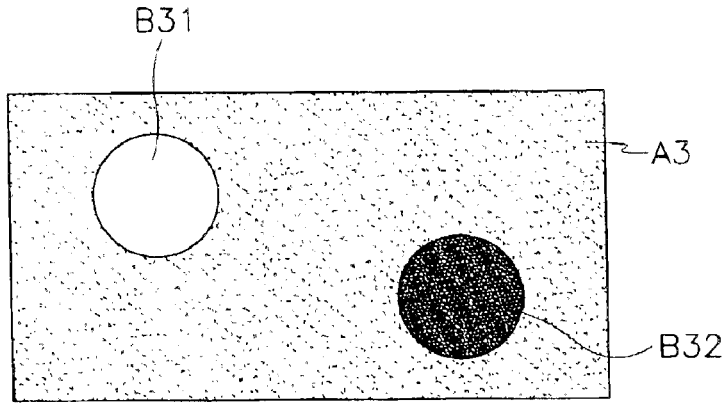
FIG. 8 is a view showing a screen where the background is gray, and a relatively small image of a bright gray scale, that is close to white in color, and another relatively small image of a dark gray scale, that is close to black in color, exist in the background.

As shown in FIG. 8, when the background A3 is gray and the image B31 of the bright gray scale, close to white in color, and the image B32 of the dark gray scale, close to black in color, exist in the background A3, the contrast correcting circuit according to the third embodiment of the present invention operates to prevent the occurrence of the opposite negative consequences caused by the correction of the contrast, that is, the generation of white and black distortions.

Figure 6:
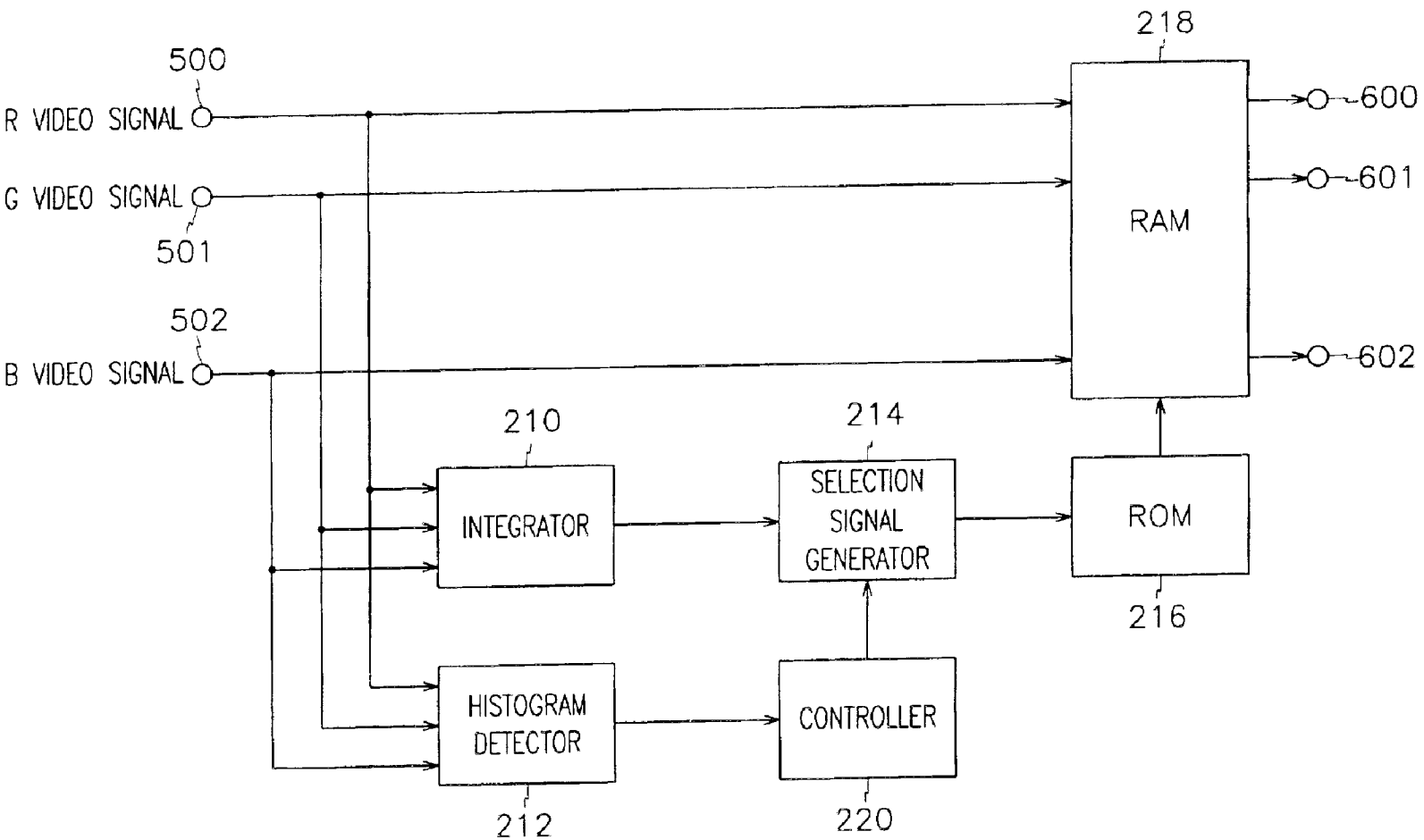
FIG. 6 is a block diagram showing the structure of a contrast correcting circuit according to a third embodiment of the present invention.

The structure of the contrast correcting circuit according to the third embodiment of the present invention is shown in FIG. 6. The contrast correcting circuit according to the third embodiment senses the frequency of uniform and a large amount of gray scales in a video signal. When the amount exceeds a predetermined value, it is determined that information exists in another gray scale, and the selection signal of the table data showing the contrast conversion characteristic is manipulated. Accordingly, the white distortion in the dark screen or the black distortion in the bright screen is improved.

Referring to FIG. 6, the contrast correcting circuit includes an integrator 210, a histogram detector 212, a selection signal generator 214, ROM 216, RAM 218, and a controller 220.

The integrator 210 integrates the brightness levels of the video signals received from input terminals 500, 501 and 502, and calculates the sum of the brightness levels of the video signals for the entire screen.

The histogram detector 212 divides the gray scales of the R, G, and B video signals received from the input terminals 500, 501 and 502 into a plurality of regions, detects the frequencies of the gray scales belonging to the divided regions for each pixel, and outputs the frequencies.

Setting the sum of the brightness levels of all of the pixels, when the brightness levels of all of the pixels are at a maximum, as a reference value, the selection signal generator 214 compares the reference value with the integration output of the integrator 210. On the basis of the comparison result or the output of the controller 220. The selection signal generator 214 then instructs the ROM 216 to selectively output table data suitable for the brightness of a screen, selected from the plurality of different types of table data, in consideration of the gray scales of the video signals received from the input terminals 500, 501 and 502 together with the comparison result.

The plurality of different types of table data showing the contrast conversion characteristics, which are selected according to the brightness of the screen, are stored in the ROM 216. The ROM 216 outputs the table data of the contrast conversion characteristics, which are selected by the selection signal output from the selection signal generator 214.

A conversion table for correcting the contrasts of the video signals, received from the input terminals 500 thru 502, by means of the table data output from the ROM 216 is stored in the RAM 218. The video signals having contrasts which are corrected by the conversion table stored in the RAM 218 are output through output terminals 600 thru 602.

The controller 220 receives the detection output of the histogram detector 212, determines a gray scale to be a uniform gray scale when a gray scale having a frequency greater than or equal to a previously set threshold value exists, and outputs data that indicates the gray scale determined to be the uniform data, and the frequency of the gray scale.

A ratio of the area of a display region to receive particular viewing attention to the area of an entire display screen is previously defined in a threshold value. In the case of a screen having a background which has a uniform gray scale, the threshold value is set to the number of pixels corresponding to the area of the screen of the uniform gray scale.

When data on the gray scale determined to be uniform gray scale by the controller 220, and the frequency of the gray scale is received, the selection signal generator 214 sets a reference value, which is compared with the output of the integrator 210, to a value obtained by subtracting the product of the gray scale determined to be the uniform gray scale and the frequency of the gray scale from the sum of the brightness levels of all of the pixels when the brightness levels of all of the pixels of the screen are maximum. The selection signal generator 214 then instructs the ROM 216 to selectively output the table data suitable for the brightness of a screen selected from the plurality of table data on the basis of a value obtained by dividing the reference value by the sum of the brightness levels when the brightness levels of all of the pixels of the picture region (except for the picture region occupied by the gray scale determined to be the uniform gray scale) are at a maximum with respect to one screen.

The plurality of different types of table data showing the contrast conversion characteristics, which are stored in the ROM 222, were described with reference to FIG. 2 in the above explanation of the first embodiment of the present invention.

The operation of the contrast correcting circuit according to the third embodiment of the present invention will now be described.

In the case of the screen shown in FIG. 3, because the output of the integrator 210, which is the sum (the mean level) of the brightness levels of the video signals of the entire screen, has a low value, when the histogram detector 212 and the controller 220 are not included in the structure of FIG. 6, the contrast conversion table corresponding to the dark screen is selected, and the contrast of the bright area is sacrificed. Accordingly, the contrast of the dark area is emphasized.

Despite the fact that the important video signals exist in the bright area, the contrast of this area is reduced. Accordingly, a phenomenon such as white distortion occurs.

As shown in FIG. 7, unlike in FIG. 3, in the screen where most of the background A2 is the gray scale of white level, and the image B2 of the dark gray scale, close to black in color, exists in the background A2, the contrast conversion table corresponding to the bright screen is selected, and the contrast of the dark area in the screen is sacrificed. Accordingly, the contrast of the bright area is sacrificed. Therefore, in the case of the screen shown in FIG. 7, a phenomenon such as black distortion occurs.

As shown in FIG. 8, in the screen where the background A3 is gray and the image B31 of the bright gray scale, close to white in color, and the image B32 of the dark gray scale, close to black in color, exist in the background A3, the contrast conversion table corresponding to white of the background A3 is selected, and the contrasts of the white and black areas are sacrificed in the screen. Accordingly, the contrast of the background A3 of the gray part is emphasized. Therefore, in the case of the screen shown in FIG. 8, both white and black distortions may occur.

Figure 9:
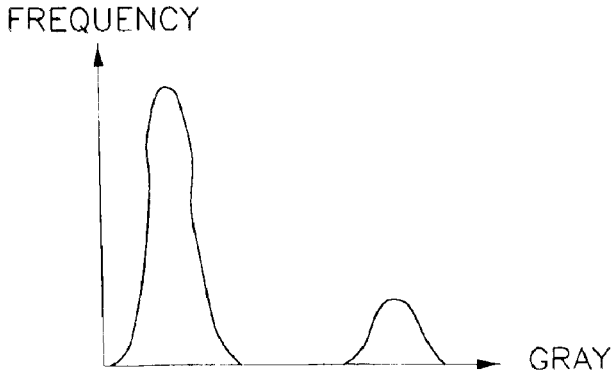
FIG. 9 is a histogram showing the relationship between a gray scale and a frequency, both for video signals, for displaying the screen of FIG. 3.
Figure 10:
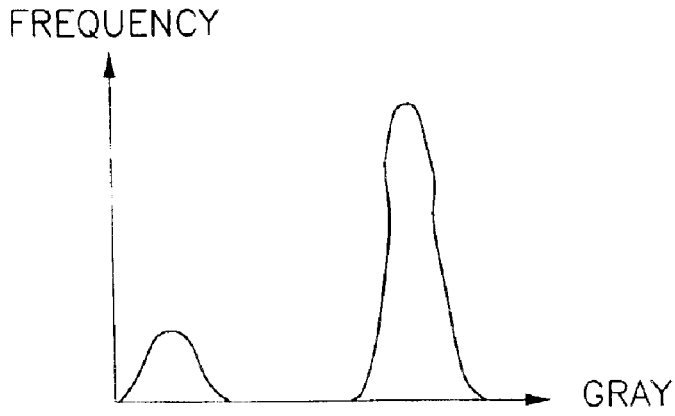
FIG. 10 is a histogram showing the relationship between a gray scale and a frequency, both for video signals, for displaying the screen of FIG. 7.
Figure 11:
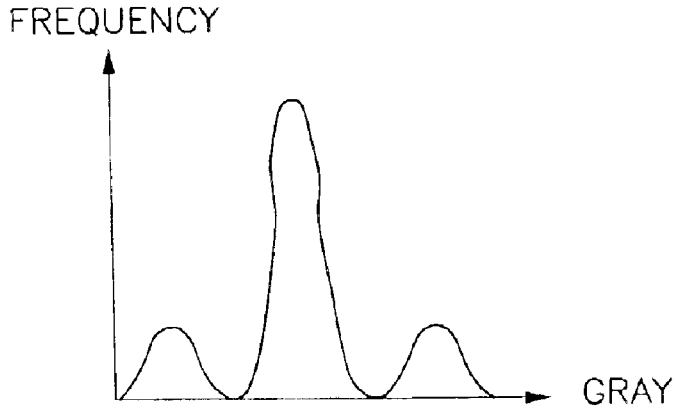
FIG. 11 is a histogram showing the relationship between a gray scale and a frequency, both for video signals, for displaying the screen of FIG. 8.

When the video signals displaying the screens shown in FIGS. 3, 7 and 8 are received from the input terminals 500, 501 and 502, the histogram detector 212 outputs data exhibiting the gray scale and the frequency shown by the histograms shown in FIGS. 9 thru 11. The histograms of FIGS. 9, 10 and 11 correspond to the screens shown in FIGS. 3, 7, and 8, respectively.

According to the third embodiment of the present invention, the controller 220, for example, senses that the gray scale of the video signal is the black level when the gray scale of the video signal is in the range of 0–5, the gray scale of the video signal is the gray level when the gray scale of the video signal is in the range of 125–130, and the gray scale of the video signal is the white level when the gray scale of the video signal is in the range of 250–255.

In the case of the screens represented in FIGS. 9, 10 and 11, since the sum of the brightness levels of the video signals of the entire screen, which is calculated by the integrator 210, is determined by the gray scale that occupies most of the area of the screen, the above phenomenon occurs.

In order to avoid such a phenomenon, according to the present invention, the sum of the video signals is integrated by the integrator 210, the gray scales of the R, G and B video signals received from the input terminals 500, 501 and 502 by the histogram detector 212 are divided into a plurality of regions, and the frequencies of the gray scales belonging to the respective divided regions are detected and output.

When there exists a gray scale having a frequency that exceeds the threshold value, which is externally established, the controller 220 outputs the frequency of each gray scale to the selection signal generator 214 on the basis of the output of the histogram detector 212. The controller 220 outputs data showing a gray scale D for modifying the operation of the selection signal calculated by the selection signal generator 214 and the frequency H of the gray scale. The threshold value is a standard by which it is determined whether a gray scale is uniform when a frequency (an area) exceeds a predetermined level in a histogram.

When the range of a gray scale that is disregarded, that is, the range of a gray scale whose contrast need not be corrected, is designated externally in the controller 220, the controller 220 does not output data as to the frequency of the designated gray scale.

In the case of a screen where the ratio of the area of the display region in the entire display screen that receives particular viewing attention is pre-defined and the background is uniform (for example, in the case of the black screen), the threshold value can be set to the number of pixels corresponding to the area of the black screen. For example, when the background is black and a relatively small image (the display region is ¼ of the entire screen) of the bright gray scale that is close to white in color is displayed on the black background, the value set as the threshold value in the controller 220 is 852×480×¾=306720 when ¾ of the 852×480 display screen is black.

The selection signal generator 214 calculates a selection signal according to the following formula on the basis of the gray scale D and the frequency H output from the controller 220 when the gray scale having the frequency that exceeds the threshold value exists.

$$S0' = (\text{the output (the sum) of the integrator } \mathbf{210} - D \times H) \quad (1)$$

$$Sm' = \{852(\text{dots}) \times 480(\text{lines}) - H\} \times 255(\text{8 bit maximum value}) \times 3(RGB) \quad (2)$$

$$\text{Selection signal} = S0'/Sm' \quad (3)$$

D×H is the sum of the brightness levels of the number of all of the pixels (the number of dots) of the picture region occupied by an image of a uniform gray scale where an influence on the image receiving particular viewing attention is to be avoided when the contrast is corrected in the screen. S0' is the sum of the brightness levels in the picture region in the screen that receives particular viewing attention.

Sm' is the sum of the brightness levels of all of the pixels of the picture region that receives particular viewing attention, that is, the sum (the maximum value) of the brightness levels that can be obtained in the picture region to receive particular viewing attention when the brightness levels of the respective pixels are at a maximum in the picture region in the screen receiving particular viewing attention.

As mentioned above, the selection signal is calculated by the selection signal generator 214 and, as a result of outputting the calculated selection signal to the ROM 216, the table data having a contrast conversion characteristic suitable for the image receiving particular viewing attention is selected when the contrast of the video signal is corrected. Hence, the influence of the gray scale picture region that is uniform and occupies a wide area in a screen is avoided, thereby preventing the above-mentioned negative consequences described with reference to FIGS. 9, 10 and 11.

According to the present invention, it is possible to prevent white distortion when correction is performed with respect to the contrast of a screen wherein relatively bright images taking up a small area exist in a picture with a large number of pixels of the black level.

The noise component of the video signal is excluded and the table data having an appropriate contrast conversion characteristic is selected with respect to the image receiving particular viewing attention with respect to a screen with a large amount of pixel data of the black level. It is possible to prevent negative consequences, such as white distortion, in a screen wherein most of the background is occupied by pixels of the black level.

When the contrast of the video signal is corrected, in the case where the picture of the gray scale that is uniform and occupies a wide area exists in a screen, the table data having the appropriate contrast conversion characteristic is selected with respect to an image receiving particular viewing attention so as to avoid the influence of the picture. Therefore, it is possible to prevent negative consequences such as white distortion in a dark screen and black distortion in a bright screen when the contrast is corrected.

Also, even though the contrast of the video signal is intentionally processed, the negative consequences can be prevented.

Because the table data having the appropriate contrast conversion characteristic is selected with respect to an image receiving particular viewing attention in a screen wherein the background has uniform gray scales, it is possible to avoid the influence of the background having the uniform gray scales when the contrast is corrected.

Also, it is possible to reduce the amount of data when the contrast is corrected and to reduce the processing load.

Although preferred embodiments of the present invention have been described, it will be understood by those skilled in the art that the present invention should not be limited to the described preferred embodiments. Rather, various changes and modifications can be made within the spirit and scope of the present invention, as defined by the following claims.

What is claimed is:

1. A contrast correcting circuit, comprising:

an integrator for integrating brightness levels of received video signals, and for calculating a sum of the brightness levels of the video signals for an entire screen;

a first memory for storing a plurality of different types of table data exhibiting contrast conversion characteristics according to a brightness of the screen;

a selector for setting, as a reference value, a sum of the brightness levels of all pixels of the screen when the brightness levels of said all pixels of the screen are at a maximum, for comparing the reference value with an integration output of the integrator to produce a comparison result, and for instructing the first memory to selectively output table data suitable for the brightness of the screen selected from the plurality of different types of table data on the basis of the comparison result;

a second memory for storing a conversion table for correcting contrasts of the received video signals by means of the table data output from the first memory; and a black level detector for detecting the brightness levels of the received video signals for each pixel, for determining the brightness levels of the video signals to be a black level when the brightness levels of the video signals have values no greater than a predetermined value, and for outputting data indicating a number of pixels of the black level, wherein, when the number of pixels of the black level indicated by the data output of the black level detector is no less than a certain value, the selector sets the reference value which is compared with the integration output of the integrator to a value obtained by subtracting the number of pixels of the black level from the sum of the brightness levels of said all pixels of the screen when the brightness levels of said all pixels of the screen are at a maximum.

2. The circuit of claim 1, wherein the predetermined value is set as the number of pixels corresponding to an area of a black screen when a ratio of an area of a display region receiving particular viewing attention to an area of an entire display screen is pre-defined and a background is a black screen.

3. The circuit of claim 1, wherein the brightness levels of the video signals are determined to be the black level when the gray scales of the video signals are in a range of 0 to 5.

4. The circuit of claim 1, wherein table data showing a conversion characteristic, which is obtained by uniformly dividing a space between a characteristic selected with respect to an entirely dark picture, where a mean value of the brightness levels of the video signals is small, and a characteristic selected with respect to an entirely bright picture, where the mean value of the brightness levels of the video signals is large, is stored in the first memory.

5. The circuit of claim 4, wherein table data exhibiting 16 conversion characteristics are stored in the first memory.

6. A contrast correcting circuit, comprising:

an integrator for integrating brightness levels of received video signals, and for calculating a sum of the brightness levels of the video signals for an entire screen;

a first memory for storing a plurality of different types of table data exhibiting contrast conversion characteristics according to a brightness of the screen;

a selector for setting, as a reference value, a sum of the brightness levels of all pixels of the screen when the brightness levels of said all pixels of the screen are at a maximum, for comparing the reference value with an integration output of the integrator to produce a comparison result, and for instructing the first memory to selectively output table data suitable for the brightness of the screen selected from the plurality of different types of table data on the basis of the comparison result;

a second memory for storing a conversion table for correcting contrasts of the received video signals by means of the table data output from the first memory; and a corrector for correcting the reference value when black levels of the received video signals continuously exist for each pixel, and a number of continuous pixels is no less than a predetermined value;

wherein, when a correction input from the corrector exists, the selector sets the reference value corrected in accordance with the correction input as a reference value, and specifies the table data to be selected from the plurality of different types of table data.

7. The circuit of claim 6, wherein the corrector comprises:

a black level detector for detecting the brightness levels of the received video signals for each pixel, and for determining the brightness levels of the video signals to be a black level when the brightness levels of the video signals have values no greater than a predetermined value;

a first counter for counting a number of pixels of the black level detected by the black level detector in a horizontal scan period for a certain number of pixels, which is established externally, by means of a set number of pixels only when the pixels are continuous, and for outputting the counted number of pixels of the black level with respect to the respective lines of a row direction of the screen; and a second counter for receiving a count output of the first counter when the count values of the number of pixels of the black level are continuously input from the first counter with respect to the number of lines of the row direction of the screen set externally, and for outputting a sum of the count values to the selector as a count value, wherein the selector sets the reference value compared with the output of the integrator as a value obtained by replacing a value, indicating the number of said all pixels of the screen in a calculation formula that indicates the sum of the brightness levels of said all pixels when the brightness levels of said all pixels of the screen are at a maximum, by a value obtained by subtracting the count value of the number of pixels of the black level output from the second counter from the value indicating the number of said all pixels of the screen.

8. The circuit of claim 7, wherein the number of pixels set by the first counter and the number of lines set by the second counter are determined by considering a noise component with respect to the video signals.

9. The circuit of claim 8, wherein the number of pixels set by the first counter is four, and the number of lines set by the second counter is four.

10. The circuit of claim 6, wherein the brightness levels of the video signals are determined to be the black level when gray scales of the video signals are in a range of 0 to 5.

11. The circuit of claim 6, wherein table data showing a conversion characteristic, which is obtained by uniformly dividing a space between a characteristic selected with respect to an entirely dark picture, where a mean value of the brightness levels of the video signals is small, and a characteristic selected with respect to an entirely bright picture, where the mean value of the brightness levels of the video signals is large, is stored in the first memory.

12. The circuit of claim 11, wherein table data showing 16 conversion characteristics are stored in the first memory.

13. A contrast correcting circuit, comprising:

an integrator for integrating brightness levels of received video signals, and for calculating a sum of the brightness levels of the video signals for an entire screen;

a first memory for storing a plurality of different types of table data exhibiting contrast conversion characteristics according to a brightness of the screen;

a selector for setting, as a reference value, a sum of the brightness levels of all pixels of the screen when the brightness levels of said all pixels of the screen are at a maximum, for comparing the reference value with an integration output of the integrator to produce a comparison result, and for instructing the first memory to selectively output table data suitable for the brightness of the screen selected from the plurality of different types of table data;

a second memory for storing a conversion table for correcting contrasts of the received video signals by means of the table data output from the first memory;

a histogram detector for dividing gray scales of the received video signals into a plurality of regions, and for detecting frequencies of scales belonging to the divided regions in unit of pixels; and a controller for receiving a detection output of the histogram detector, for determining the gray scale to be uniform when a gray scale having a frequency which is no less than a previously set threshold value exists, and for outputting data on the gray scale determined to be uniform and the frequency of the gray scale;

wherein, when data on the gray scale, determined to be a uniform gray scale by the controller, and the frequency of the gray scale are received, the selector sets the reference value, which is compared with an output of the integrator, as a value obtained by subtracting a product of the gray scale, determined to be the uniform gray scale, and the frequency of the gray scale from a sum of the brightness levels of said all pixels when the brightness levels of said all pixels of the screen are at a maximum, and wherein the selector then instructs the first memory to selectively output table data suitable for the brightness of the screen selected from the plurality of different types of table data on the basis of a value obtained by dividing the reference value by the sum of the brightness levels when the brightness levels of said all pixels of the picture region, except for the picture region occupied by the gray scale determined to be the uniform gray scale, are at a maximum with respect to one screen.

14. The circuit of claim 13, wherein, in a screen where a ratio of an area of a display region to receive particular viewing attention to an area of an entire display screen is previously defined and a background has uniform gray scales, the threshold value is set to a number of pixels corresponding to an area of the screen of the uniform gray scales.

15. The circuit of claim 14, wherein, when a frequency is set with respect to a gray scale that is not supposed to be determined in determining whether a gray scale is uniform, the controller does not output data on the frequency of the gray scale.

16. The circuit of claim 13, wherein the brightness levels of the video signals are determined to be a black level when gray scales of the video signals are in a range of 0 to 5;

wherein the brightness levels of the video signals are determined to be a gray level when the gray scales of the video signals are in a range of 125 to 130; and wherein the brightness levels of the video signals are determined to be a white level when the gray scales of the video signals are in a range of 250 to 255.

17. The circuit of claim 13, wherein table data showing conversion characteristics, obtained by uniformly dividing a space between a characteristic selected with respect to an entirely dark picture, where a mean value of the brightness levels of the video signals is small, and a characteristic selected with respect to an entirely bright picture, where the mean value of the brightness levels of the video signals is large, are stored in the first memory.

18. The circuit of claim 13, wherein table data showing 16 conversion characteristics are stored in the first memory.

19. The circuit of claim 13, wherein the selector instructs the first memory to selectively output the table data suitable for the brightness of the screen selected from the plurality of different types of table data on the basis of the comparison result.

20. The circuit of claim 13, wherein the selector instructs the first memory to selectively output the table data suitable for the brightness of the screen selected from the plurality of different types of table data in consideration of the gray scales of the received video signals together with the comparison result.

21. The circuit of claim 13, wherein, when a frequency is set with respect to a gray scale that is not supposed to be determined in determining whether a gray scale is uniform, the controller does not output data on the frequency of the gray scale.

* * * * *